United States Patent [19]

Graf et al.

[11] Patent Number: 4,518,487

[45] Date of Patent: May 21, 1985

[54] PROCESS FOR IMPROVING PRODUCT YIELDS FROM DELAYED COKING

[75] Inventors: Harlan G. Graf; Harry R. Janssen, both of Ponca City, Okla.

[73] Assignee: Conoco Inc., Ponca City, Okla.

[21] Appl. No.: 590,607

[22] Filed: Mar. 19, 1984

Related U.S. Application Data

[63] Continuation-in-part of Ser. No. 519,291, Aug. 1, 1983, abandoned.

[51] Int. Cl.[3] ..... C10G 9/14

[52] U.S. Cl. ..... 208/131

[58] Field of Search ..... 208/131

[56] References Cited

U.S. PATENT DOCUMENTS

| | | | |
|---|---|---|---|
| 2,039,763 | 5/1936 | Andrews et al. | 208/131 |
| 2,159,502 | 5/1939 | Corrough | 208/131 |
| 2,161,247 | 6/1939 | Dearborn | 208/131 |
| 2,380,713 | 7/1945 | Wilson | 208/131 |
| 3,116,231 | 12/1963 | Adee | 208/131 |
| 3,379,638 | 4/1968 | Bloomer et al. | 208/131 |
| 3,472,761 | 10/1969 | Cameron | 208/131 |
| 3,563,884 | 2/1971 | Bloomer et al. | 208/131 |
| 3,799,865 | 3/1974 | Suetsugu et al. | 208/131 |
| 3,817,853 | 6/1974 | Folkins | 208/131 |
| 3,960,704 | 6/1976 | Kegler et al. | 208/131 |
| 4,036,736 | 7/1977 | Ozaki et al. | 208/106 |
| 4,111,794 | 9/1978 | Pietzka et al. | 208/131 |
| 4,176,045 | 11/1979 | Leftin et al. | 208/131 |
| 4,176,047 | 11/1979 | Orrell et al. | 208/131 |
| 4,177,133 | 12/1979 | Hayashi et al. | 208/131 |
| 4,216,074 | 8/1980 | Simone | 208/10 |
| 4,455,219 | 6/1984 | Janssen et al. | 208/131 |

OTHER PUBLICATIONS

Hydrocarbon Processing Jul. 1971, "How Delayed Coking Works" p. 87.

The Oil and Gas Journal, "Delayed Coking" Jan. 2, 1956, p. 89.

*Primary Examiner*—Delbert E. Gantz

*Assistant Examiner*—Helane Myers

*Attorney, Agent, or Firm*—Richard W. Collins

[57] ABSTRACT

A delayed coking process in which the coker furnace feed is free of conventional heavy recycle. Elimination of this material from the coker furnace feed produces, based on fresh feed to the process, increased liquids and decreased coke. Coker furnace feed is initially combined with a diluent hydrocarbon having a lower boiling range than conventional heavy coker recycle and then transferred to the coker furnace. The hydrocarbon diluent is much lower in coke-forming components than the heavy recycle which is normally combined with the fresh feed and fed to the coker furnace.

9 Claims, 2 Drawing Figures

Case No. 7066.1

Case No. 7066.1

PROCESS FOR IMPROVING PRODUCT YIELDS FROM DELAYED COKING

RELATED APPLICATION

This application is a continuation-in-part of co-pending application Ser. No. 519,291, filed Aug. 1, 1983 now abandoned.

BACKGROUND OF THE INVENTION

1. Field of the Invention

This invention relates to delayed coking, and more particularly to a method of improving the product yields from a delayed coking operation.

Delayed coking has been practiced for many years. The process broadly involves thermal decomposition of heavy liquid hydrocarbons to produce gas, liquid streams of various boiling ranges, and coke.

Coking of resids from heavy, sour (high sulfur) crude oils is carried out primarily as a means of disposing of low value resids by converting part of the resids to more valuable liquid and gas products. The resulting coke is generally treated as a low value by-product.

In the production of fuel grade delayed coke, and even to some extent in the production of anode or aluminum grade delayed coke, it is desirable to minimize the coke yield, and to maximize the liquids yield, as the liquids are more valuable than the coke. It is also desirable to produce a coke having a volatile matter content of not more than about 15 percent by weight, and preferably in the range of 6 to 12 percent by weight.

The use of heavy crude oils having high metals and sulfur content is increasing in many refineries, and delayed coking operations are of increasing importance to refiners. The increasing concern for minimizing air pollution is a further incentive for treating resids in a delayed coker, as the coker produces gases and liquids having sulfur in a form that can be relatively easily removed.

2. The Prior Art

In the basic delayed coking process as practiced today, fresh feedstock is introduced into the lower part of a coker fractionator and the fractionator bottoms including heavy recycle material and fresh feedstock are heated to coking temperature in a coker furnace. The hot feed then goes to a coke drum maintained at coking conditions of temperature and pressure where the feed decomposes or cracks to form coke and volatile components. The volatile components are recovered as coker vapor and returned to the fractionator. Heavy gas oil from the fractionator is added to the flash zone of the fractionator to condense the heaviest components from the coker vapors. The heaviest fraction of the coke drum vapors could be condensed by other techniques, such as heat exchange, but in commercial operations it is common to contact the incoming vapors with a heavy gas oil in the coker fractionator. Conventional heavy recycle is comprised of condensed coke drum vapors and unflashed heavy gas oil. When the coke drum is full of coke, the feed is switched to another drum, and the full drum is cooled and emptied by conventional methods.

The delayed coking process is discussed in an article by Kasch et al entitled "Delayed Coking," *The Oil and Gas Journal,* Jan. 2, 1956, pp 89–90.

A delayed coking process for coal tar pitches illustrating use of heavy recycle is shown in U.S. Pat. No. 3,563,884 to Bloomer et al.

A delayed coking process for coal extract using a separate surge tank for the feed to the coker furnace is shown in U.S. Pat. No. 3,379,638 to Bloomer et al.

A process for producing a soft synthetic coal having a volatile matter content of more than 20 percent by weight is described in U.S. Pat. No. 4,036,736 to Ozaki et al. In that reference, a diluent gas is added to the coker drum to maintain a reduced partial pressure of cracked hydrocarbons, or the process is carried out under less than atmospheric pressure.

A discussion of early delayed coking processes appears in an article by Armistead entitled "The Coking of Hydrocarbon Oils," *The Oil and Gas Journal,* Mar. 16, 1946, pp 103–111.

U.S. Pat. No. 4,216,074 describes a dual coking process for coal liquefaction products wherein condensed liquids from the coke vapor stream and unflashed heavy gas oil are used as recycle liquid to the coker furnace.

U.S. Pat. No. 4,177,133 describes a coking process in which the heavier material from the coke drum vapor line is combined with fresh coker feed as recycle and then passed to a coke drum.

Many additional references, of which U.S. Pat. Nos. 2,380,713; 3,116,231 and 3,472,761 are exemplary, disclose variations and modifications of the basic delayed coking process.

In commonly assigned copending application Ser. No. 464,181, filed Feb. 9, 1983 now U.S. Pat. No. 4,455,219, a delayed coking process is described in which a diluent hydrocarbon having a boiling range lower than the boiling range of heavy recycle is substituted for a part of the heavy recycle that is normally combined with the fresh feed in delayed coking processes.

SUMMARY OF THE INVENTION

According to the present invention, the feed to a coker furnace is essentially free of unflashed heavy coker gas oil and condensed material from the coke drum vapors. This is accomplished by removing from the process unflashed heavy coker gas oil and condensed material from coke drum vapors, rather than combining them with fresh coker feed as is conventionally done.

A hydrocarbon diluent having a boiling range lower than that of conventional heavy coker recycle, and having a lower amount of coke-forming components than heavy coker recycle does, is combined with the fresh feed in an amount sufficient to effectively prevent coke formation in the furnace tubes. The amount of diluent needed depends on the quality of the feedstock, furnace temperature, furnace design and other factors.

Normally, the coker feedstock is fed to the bottom of the coker fractionator where it inherently mixes with unflashed heavy coker gas oil and condensed material from the coker vapor stream. The process described in the aforementioned U.S. Pat. No. 4,455,219 is directed to minimizing the amount of heavy recycle which is combined with the fresh feed. The present invention is directed to the total elimination of heavy recycle from the coker feedstock.

It is an object of the present invention to improve the product yields from a delayed coking operation.

It is a further object to eliminate unflashed heavy coker gas oil and condensed coker vapors from the feed to a coker furnace.

It is still a further object to substitute a lower boiling distillate hydrocarbon diluent, which is low in coke-forming components, for heavy recycle which is relatively much higher in coke-forming components, as part of the feed to a coker furnace.

THE DRAWINGS

FIG. 1 designated PRIOR ART is a schematic flow diagram illustrating the conventional delayed coking process.

FIG. 2 is a schematic flow diagram illustrating the preferred embodiment of the process of this invention.

DETAILED DESCRIPTION OF THE PRIOR ART PROCESS

Figure 1:
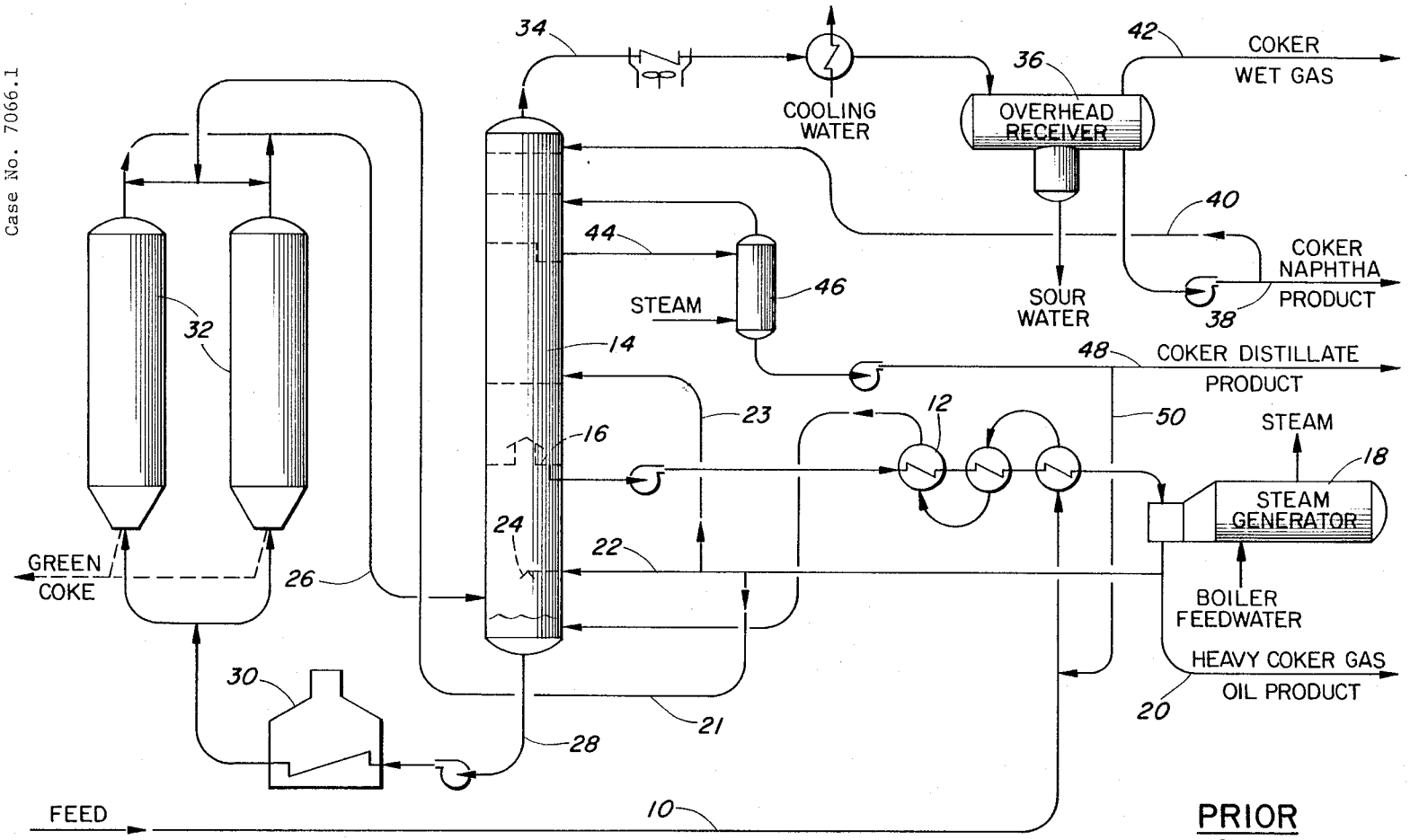
PRIOR ART FIG. 1

A conventional prior art delayed coking process is illustrated in FIG. 1. In that process, fresh coker feed from line 10 is preheated in heat exchangers 12 and then fed to the bottom of coker fractionater 14. Heavy coker gas oil from draw pan 16 is pumped through heat exchangers 12 and steam generator 18. Part of the heavy coker gas oil from steam generator 18 is recovered as a product through line 20, part of it is passed via line 21 to the vapor outlets of coke drums 32 where it is used to quench coke drum vapors, part of it is returned via line 22 to spray nozzles 24 in the flash zone of fractionator 14 and the remainder is returned to the fractionator through line 23 as internal reflux. In many coker fractionators, a series of baffles, sometimes referred to as a "shed deck," is utilized in place of spray nozzles to effect contact between gas oil and incoming vapors. Trays or other means may be used for this purpose. Heavy gas oil added to a shed deck or trays performs the function as the spray oil referred to herein. Coke drum vapors from line 26 enter the flash zone of fractionator 14 below spray nozzles 24, and the heaviest components in the incoming vapors are condensed by contact with heavy coker gas oil from spray nozzles 24. The condensed material falls into the bottom of the flash zone where it combines with the incoming fresh feed. Any heavy coker gas oil from spray nozzles 24 which is not vaporized in the flash zone also combines with the fresh feed in the bottom of the flash zone.

The combined fresh feed, condensed vapors and unflashed heavy gas oil is withdrawn through line 28 and pumped to coker furnace 30 where it is heated to coking temperature and then passed to one of the coke drums 32. As is conventional, one coke drum is filled while the other is cooled and emptied, and when the drum being filled is full of coke the heated feed is switched to the empty drum. Vapors from either drum 32 pass through vapor line 26 to fractionator 14. A small amount of heavy coker gas oil from line 21 is added to the vapor exiting drum 32 to quench the vapors and prevent coke deposition in line 26.

Lighter material from line 26 passes up through fractionator 14, and gases and naphtha exit through line 34. Naphtha is condensed out in receiver 36 and recovered from line 38. A part of the naphtha may be refluxed back though line 40. Coker gases are recovered as product through line 42. An intermediate distillate is removed via line 44, steam stripped in stripper 46, and recovered through distillate product line 48.

In the design and operation of a delayed coker, the furnace is the most critical piece of equipment. The furnace must be able to heat the feedstock to coking temperatures without causing coke formation on the furnace tubes. When the furnace tubes become coked, the operation must be shut down and the furnace cleaned out. In some cases, steam is injected into the furnace tubes to increase the tube velocity and to create turbulence as a means of retarding coke deposits. However, steam injection is not energy efficient and can adversely affect coke quality, and therefore is preferably minimized. It is, however, important to have steam injection capability to blow out the furnace tubes in the event of furnace fuel pump failure. Properly designed and operated coker furnaces can now operate for many months without being shut down for tube cleanout.

It is conventional in the production of fuel grade or anode grade coke to recycle from about 0.05 to about 0.7 volumes of heavy recycle material for each volume of fresh coker feed. This recycle material improves the coker furnace operation and also provides a solvent effect which aids in preventing coke deposits on the furnace tubes. Conventional heavy recycle material, as mentioned previously, is a combination of condensed material from the coke drum vapor line and unflashed heavy coker gas oil, generally having a boiling rage of from about 750° to 950° F. or higher, although small amounts of components boiling below 750° F. may be present. The operation of a coker as described above, where condensed vapors and unflashed heavy gas oil are combined with fresh feed in the bottom of the coker fractionator, inherently results in at least a minimum amount of heavy recycle material being combined with the fresh feed. This minimum amount is about 0.05 volumes of recycle for each volume of fresh feed.

In cases where the feedstock is of lower quality, such as a very low gravity resid, it may be necessary to have as much as 0.3 to 0.7 volumes of recycle for each volume of fresh feed in order to prevent coke formation in the furnace. The use of these higher recycle rates is undesirable in that it affects the production capacity of the coker, and more importantly, it increases the coke yield measured as a percentage of the fresh feed. The increase in the coke yield from using high recycle rates of heavy recycle material is a result of coke formation from the recycle material itself. This is undesirable because the coke is the least valuable product from the coking operation.

The process described in U.S. Pat. No. 4,455,219 mentioned previously represents an improvement wherein the amount of heavy recycle used is minimized, and a lighter distillate material is added to the fresh feed to provide part of the necessary diluent to prevent coking in the furnace tubes. This process is represented in FIG. 1 where distillate from line 48 is withdrawn and passed through line 50 to be combined with fresh feed before it is preheated. That process is particularly useful when the coker feedstock is such that more than about 0.05 volumes of recycle per volume of fresh feed is required for proper furnace operation.

DESCRIPTION OF THE PREFERRED EMBODIMENT

The present invention is an improvement over the prior art processes described above in that it entirely eliminates the use of heavy recycle material in the production of fuel grade or anode grade coke, thus resulting in improved product yields including a reduced coke yield and an increased liquids yield. As pointed out previously, the preferred product yields include the lowest possible amount of coke, as the other products from a coking operation are of greater value than the coke.

Figure 2:
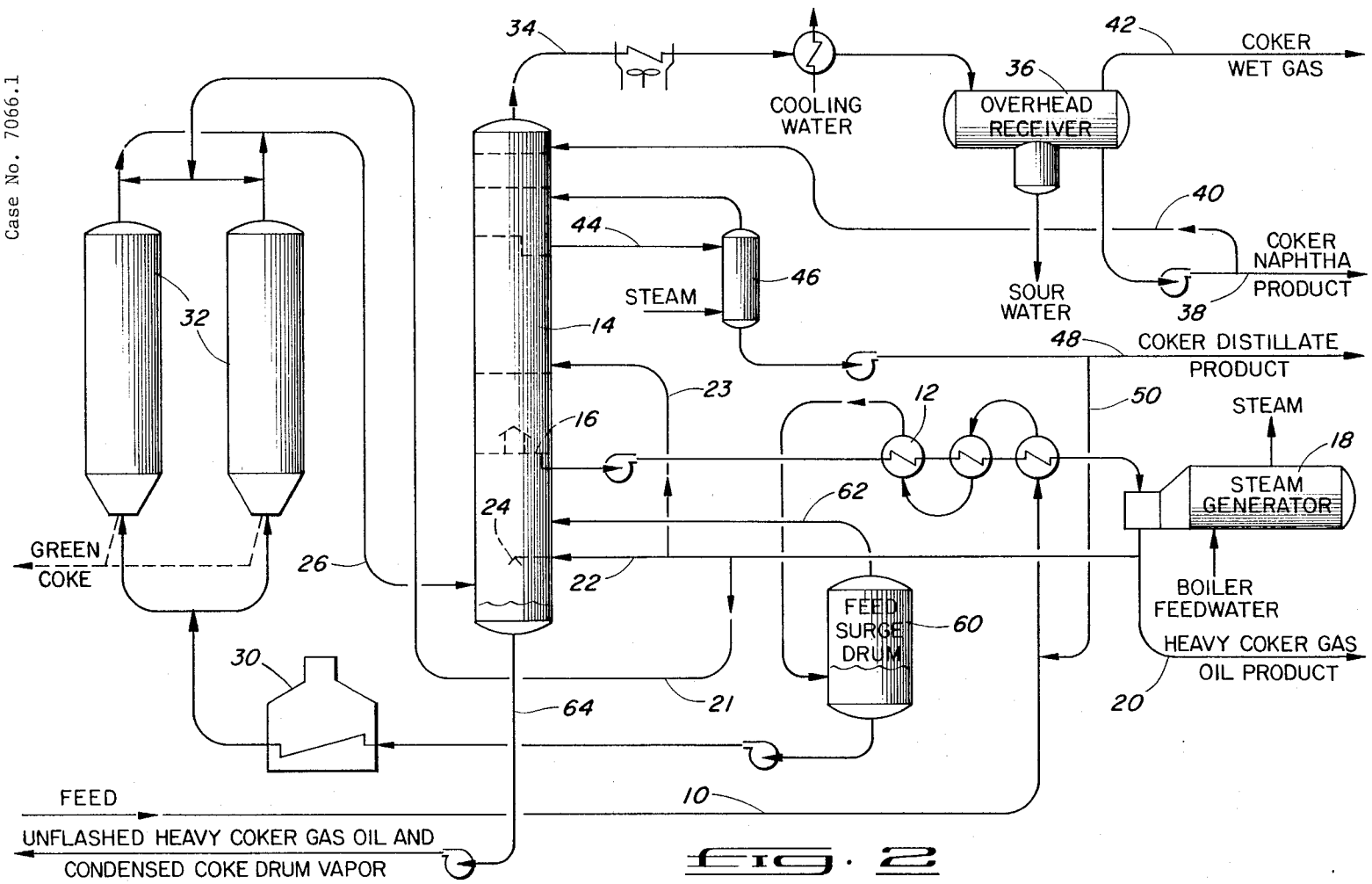

The preferred embodiment of the invention is illustrated in FIG. 2, where like numbers are used for those items which are common in FIG. 1. The main difference between the preferred embodiment of the invention and the prior art is the total elimination of heavy recycle material from the feedstock, even in those cases where a high amount of diluent is necessary to provide furnace operation.

The elimination of heavy recycle material from the feed is accomplished by routing fresh coker feed to a feed surge drum (FIG. 2) instead of to the bottom of fractionator 14 as is done in prior art processes (FIG. 1). Fresh feed from surge drum 60 is then passed directly, without any addition of heavy recycle, to coker furnace 30. In lieu of the heavy recycle normally used to prevent coke deposition in the furnace tubes, an amount of coker distillate sufficient to effectively prevent coke deposition on the furnace tubes is added to the fresh feed via line 50 before it is passed to the coker furnace.

In the embodiment of this invention illustrated in FIG. 2, heavy gas oil is added to the flash zone of fractionator 14 to condense heavy coke drum vapors and to clean up the material entering the flash zone from vapor line 26. However, condensed coke drum vapors and unflashed heavy gas oil from the bottom of fractionator 14 are removed from the process via line 64, and do not contribute to the overall coke yield as they would in the prior art processes. The material from the bottom of fractionator 14 may be passed to a vacuum distillation unit where the distillable portion thereof is recovered as overhead, or the material may be hydrodesulfurized and/or used as feed to another refinery unit such as a fluidized bed catalytic cracking unit.

In the most preferred embodiment of the invention, the heavy recycle is replaced by a distillate material from the coker fractionator. This preferred distillate recycle material has a boiling range lower than that of heavy recycle, and most preferably is taken from distillate product line 48 through distillate recycle line 50 and combined with fresh feed in line 10.

The distillate recycle or diluent in accordance with the invention should be a hydrocarbon material having a boiling range of from about 335° to about 850° F., preferably from about 450° to about 750° F., and most preferably from about 510° to about 650° F. Generally the diluent will come from the coker fractionator, but diluents from other sources might be used in special instances.

The amount of diluent required is that amount needed to provide good furnace operation. This amount may be as much as 0.7 volumes diluent per volume fresh feed for those feeds which have a very high tendency to coke up on the furnace tubes. This amount is also a function of furnace design and furnace operating conditions, and generally must be determined for each feedstock and each coker furnace. The preferred amount of diluent is the minimum amount which enaables operation without significant furnace tube coking. Use of more than the minimum amount which prevents significant furnace tube coking is not particularly bad, but may affect capacity and efficiency of the operation.

Suitable feedstocks for the process of the invention include any conventional delayed coking feedstock. The most common feedstock for fuel grade or anode grade coke is petroleum residuum. Usually the residuum is a vacuum resid from a crude oil vacuum distillation unit, but occasionally an atmospheric resid from a crude oil atmospheric distillation unit is used. In some instances feedstocks other than petroleum residuum are coked. These feedstocks include, but are not limited to, coal tar pitch, tar sands bitumen, pyrolysis tar, slurry oil or decant oil from a fluid bed cracking unit, and shale oil. Mixtures of any of the above may also be used.

The coking operating conditions applicable to the process of the invention are those conditions which provide a product coke having a volatile matter content of not more than about 15 percent by weight, and preferably from 6 to 12 percent by weight. Such conditions, as is known in the art, include coker furnace outlet temperatures of from about 875° to 950° F., preferably 925° to 930° F., coke drum outlet vapor temperatures of 775° to 850° F., preferably about 835° F., and coker drum pressures of from 5 to 75 psig, preferably about 15 to 20 psig.

The use of subatmospheric coker drum pressure is not acceptable for several reasons. The economics of the process deteriorate rapidly as coker drum pressures approach atmospheric, and operation of a coker drum at subatmospheric pressure is very hazardous due to the likelihood of oxygen (air) leakage into the drum which contains hydrocarbons at +900° F. temperatures. Also, as pointed out in the Ozaki et al reference discussed previously, the use of atmospheric or subatmospheric coker drum pressures produces a product which is more in the nature of a pitch than a coke. For example, all of the examples in the Ozaki et al reference, carried out at atmospheric or subatmospheric drum pressure, produced a soft pitch type product having a volatile matter content of well above 20 percent by weight. The coke product from the present invention has a volatile content of not more than about 15 percent by weight, preferably 6 to 12 percent by weight.

To illustrate the coke yield potential from combining conventional heavy recycle with fresh coker feedstock, the contributions to coke yield from various fractions of a heavy coker gas oil were determined. Several boiling range fractions of heavy coker gas oil were coked individually, and the weight percent coke yield as well as the amount of each fraction was determined. The results are shown below:

TABLE 1

CONTRIBUTIONS OF EACH FRACTION TO THE WHOLE FEEDSTOCK COKE YIELD

| Heavy Coker Gas Oil Fraction | (A) Fraction of Entire Feed | (B) Batch Coke Yield Wt % | A × B, Wt % | Fractional Contribution to Entire Coke Yield |
|---|---|---|---|---|
| 550–650° F. | 0.103 | 1.3 | 0.13 | 0.8 |
| 650–750° F. | 0.221 | 4.5 | 0.99 | 6.3 |
| 750–850° F. | 0.335 | 12.8 | 4.28 | 27.5 |
| 850+° F. | 0.327 | 31.3 | 10.2 | 65.4 |
| Sum | | | 15.6 | 100.0 |

As seen in Table 1, the potential coke yield from heavy coker gas oil is significant. It is also apparent that the bulk of the coke from the heavy gas oil comes from the highest boiling fraction. It is thus especially important to eliminate the heaviest condensible material in the coker vapors and the heaviest material in the heavy coker gas oil from the feed to the coker furnace. By substituting a distillate hydrocarbon material boiling from about 335° to about 850° F. for the heavy recycle normally used, the coke yield as a percent of fresh feed is significantly reduced, and the more desirable liquid product yield is increased.

Coker fractionators are not intended to make "clean" separations, and heavy coker gas oil may contain small amounts of material boiling as low as 550° F., while coker distillate streams may have small amounts of material boiling as high as 750° F., and in some cases possibly as high as 850° F. However, the amount of this high boiling material in coker distillate (such as from line 44 in FIG. 2) is very low, and the contribution to overall coke yield from this small amount of high boiling material is not significant. On the other hand, condensed coke drum vapors and unflashed heavy coker gas oil are relatively high in +850° F. material, and contribute significantly to overall coke yield if they are combined with fresh feed as in the prior art process.

The essence of this invention is the total elimination from coker furnace feed of material from the bottom of the flash zone of the coker fractionator in a delayed coking operation operated at conditions which produce a fuel grade or anode grade delayed coke product having a volatile matter content of less than about 15 percent by weight. This is accomplished by removing from the process the materials normally combined with fresh feed as recycle, and substituting therefor in an amount sufficient to effectively prevent coke deposition on the coker furnace tubes a hydrocarbon diluent having a boiling range lower than the boiling range of conventional heavy recycle.

Expressed another way, the condensed coke drum vapors which fall to the bottom of the flash zone in the fractionator and the unflashed portion of the heavy gas oil which is added to the flash zone are collected and removed from the process rather than being combined with fresh feed as recycle, and a lower boiling hydrocarbon distillate is substituted therefor.

EXAMPLE

The improved product yields provided by this invention are demonstrated in the following simulated example derived from a highly developed coker design program. In this example, two runs were made using identical feedstocks and coking conditions, except in one case conventional heavy recycle (20 parts by volume for each 100 parts by volume fresh feed) was used for the recycle, and in the other case a hydrocarbon distillate material having a boiling range of from 510° to 650° F. (20 parts by volume for each 100 parts by volume fresh feed) was used for the recycle.

In both runs, a 1000° F.+ Bachaquero vacuum resid having an API gravity of 4.3, a Conradson carbon value of 23.5 weight percent, a UOP characterization factor "K" of 11.5 and a sulfur content of 3.5 weight percent was coked at a coke drum pressure of 20 psig and a coke drum top temperature of 835° F. The product distribution for the two runs is tabulated below:

| YIELDS - WEIGHT PERCENT | | |
|---|---|---|
| Component | Conventional Heavy Recycle | Distillate Recycle |
| $H_2S$ | 1.00 | 1.00 |
| Hydrogen | 0.09 | 0.09 |
| Methane | 3.65 | 3.53 |
| Total $C_2$ | 1.32 | 1.16 |
| Total $C_3$ | 1.58 | 1.32 |

-continued

| YIELDS - WEIGHT PERCENT | | |
|---|---|---|
| Component | Conventional Heavy Recycle | Distillate Recycle |
| Total $C_4$ | 1.71 | 1.54 |
| Liquids ($C_5$+) | 55.99 | 58.84 |
| Green Coke | 34.66 | 32.53 |
| Green Coke Volatile Matter | 9.8 | 9.4 |

As seen in the above Table, a reduction in coke yield of over 6 percent (34.66 versus 32.53) is obtained when a distillate hydrocarbon having a boiling range of 510° to 650° F. is used as recycle in place of conventional heavy coker recycle. A corresponding increase of almost 5 percent in $C_5$+ liquids is obtained (58.84 versus 55.99). Similar decreases in coke yield and increases in liquids yield are obtained with different feedstocks at the same or different coking conditions, thereby demonstrating the value of removing from the process the material normally used as recycle.

The foregoing description of the preferred embodiments of the invention is intended to be illustrative rather than limiting the invention, which is defined by the appended claims.

We claim:

1. A process for improving the product yields from delayed coking of a heavy hydrocarbon oil feedstock in a coking unit comprising a coker furnace, a coking drum and a coker fractionator to produce delayed coke and cracked liquid and gaseous hydrocarbon products comprising the steps of:

(a) delayed coking said heavy hydrocarbon oil in said coking drum under conditions at which delayed coke having a volatile matter content of not more than 15 percent by weight is produced;

(b) passing overhead vapors from said coking drum to said coker fractionator;

(c) condensing the highest boiling fraction of said overhead vapors and removing said fraction from said process; and (d) adding a diluent hydrocarbon having a lower boiling range than said highest boiling fraction to said heavy hydrocarbon oil feedstock prior to heating said heavy hydrocarbon oil feedstock to coking temperature in said coker furnace, said diluent hydrocarbon being added in an amount sufficient to effectively prevent coke deposition in said coker furnace, whereby the yield of delayed coke having a volatile matter content of less than 15 percent by weight is lower, and the liquids yield is higher, than the yields which would be obtained if said highest boiling fraction of said overhead vapors were combined with said feedstock.

2. The process of claim 1 wherein delayed coke having a volatile matter content of from 6 to 12 percent by weight is produced.

3. The process of claim 1 wherein said feedstock is initially combined with said diluent hydrocarbon, fed to a feed surge drum, and then passed directly, without addition of any other hydrocarbon material, to said coker furnace.

4. The process of claim 1 wherein said diluent hydrocarbon has a boiling range of from about 450° to about 750° F.

5. The process of claim 1 wherein said diluent hydrocarbon has a boiling range of from about 510° to about 650° F.

6. The process of claim 1 wherein said diluent hydrocarbon is a product sidestream from said coker fractionator.

7. The process of claim 6 wherein said feedstock is selected from the group consisting of petroleum vacuum resid, petroleum atmospheric resid, coal tar pitch, tar sand bitumen, slurry oil, decant oil, shale oil, pyrolysis tar and mixtures thereof.

8. The process of claim 6 wherein heavy gas oil from said coker fractionator is returned to a flash zone of said fractionator to contact incoming coker vapors and condense the highest boiling fraction therefrom.

9. The process of claim 8 wherein said diluent hydrocarbon is the only material combined with said feedstock prior to feeding said feedstock to said coker furnace.

* * * * *